US009997286B2

(12) United States Patent
Herman

(10) Patent No.: US 9,997,286 B2
(45) Date of Patent: Jun. 12, 2018

(54) MAGNETICALLY ACTUATED RESTRAINING MECHANISMS

(71) Applicant: Apple Inc., Cupertino, CA (US)

(72) Inventor: David S. Herman, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 0 days. days.

(21) Appl. No.: 15/141,696

(22) Filed: Apr. 28, 2016

(65) Prior Publication Data

US 2017/0092401 A1 Mar. 30, 2017

Related U.S. Application Data

(60) Provisional application No. 62/234,005, filed on Sep. 28, 2015.

(51) Int. Cl.
*H01F 7/20* (2006.01)
*H01F 7/02* (2006.01)

(52) U.S. Cl.
CPC ..... *H01F 7/0205* (2013.01); *H01F 7/20* (2013.01)

(58) Field of Classification Search
CPC .... H01F 7/0226; H01F 7/0242; H01F 7/0263; H01F 7/04; H05K 5/0013
USPC ..... 335/289
See application file for complete search history.

(56) References Cited

U.S. PATENT DOCUMENTS 5,921,783 A * 7/1999 Fritsch ..... H01R 13/703 439/38
6,366,440 B1 * 4/2002 Kung ..... E05C 19/16 361/147
6,564,726 B1 * 5/2003 Lindskog ..... E05G 1/14 109/25
6,653,919 B2 * 11/2003 Shih-Chung ..... G06F 1/162 24/303
6,929,291 B2 * 8/2005 Chen ..... E05C 19/16 292/251.5
7,003,333 B2 2/2006 Chow et al.
7,288,934 B1 * 10/2007 Ikarashi ..... G01R 33/09 324/207.21
7,715,187 B2 * 5/2010 Hotelling ..... G06F 1/1632 248/371
8,138,869 B1 * 3/2012 Lauder ..... G06F 1/1613 24/303
8,143,982 B1 * 3/2012 Lauder ..... G06F 1/1626 206/320

(Continued)

*Primary Examiner* — Shawki S Ismail
*Assistant Examiner* — Lisa Homza
(74) *Attorney, Agent, or Firm* — Dickinson Wright RLLP

(57) ABSTRACT

Some embodiments can include a retention mechanism having a first component including a first clasping surface and a first magnet having a first polarity as well as a second component having a second clasping surface configured to be alignable to and to coordinate with the first clasping surface. The second component can have a magnetic assembly having an effective polarity that varies in accordance with a electric current pulse received at the magnetic assembly, where a magnetic circuit is formed between the first magnet and the magnetic assembly, and where when the effective polarity of the magnetic assembly is the first polarity, the magnetic circuit is repulsive causing the first and second clasping surfaces to separate otherwise, the magnetic circuit is attractive causing the clasping surfaces to come together.

13 Claims, 6 Drawing Sheets

(56) References Cited

U.S. PATENT DOCUMENTS 8,242,868 B2 * 8/2012 Lauder ..... G06F 1/1647 24/303
8,253,518 B2 * 8/2012 Lauder ..... G06F 1/1647 206/320
8,260,381 B2 * 9/2012 Lee ..... H04M 1/0245 455/556.1
8,289,115 B2 * 10/2012 Cretella, Jr. ..... G06F 1/1626 206/320
8,364,214 B2 1/2013 Jorgensen et al.
8,390,411 B2 * 3/2013 Lauder ..... G06F 1/1626 206/320
8,395,465 B2 * 3/2013 Lauder ..... G09G 5/003 206/320
8,553,403 B2 10/2013 Chang et al.
9,035,872 B2 * 5/2015 Brown ..... G06F 3/01 345/156
2004/0056651 A1 * 3/2004 Marietta Bersana .. G01D 5/145 324/207.2
2005/0097711 A1 * 5/2005 Halstead ..... A45C 1/06 24/303
2007/0103266 A1 * 5/2007 Wang ..... H01F 7/0242 335/285
2007/0138806 A1 * 6/2007 Ligtenberg ..... E05C 19/16 292/251.5
2008/0139261 A1 * 6/2008 Cho ..... F16C 29/00 455/575.4
2008/0158800 A1 * 7/2008 Aoyagi ..... G06F 1/1616 361/679.01
2008/0174392 A1 * 7/2008 Cho ..... H04M 1/0237 335/285
2008/0186683 A1 * 8/2008 Ligtenberg ..... G06F 1/1679 361/726
2010/0300159 A1 * 12/2010 Berg ..... C09J 9/02 70/58
2011/0121084 A1 * 5/2011 Laknin ..... G06K 19/072 235/492
2011/0137145 A1 * 6/2011 Erne ..... G01R 31/318533 600/409
2011/0215740 A1 * 9/2011 Ellis ..... H05B 37/02 315/362
2012/0050975 A1 * 3/2012 Garelli ..... G06F 1/1615 361/679.27
2012/0067594 A1 * 3/2012 Noske ..... E21B 34/08 166/373
2012/0069540 A1 * 3/2012 Lauder ..... G06F 1/1626 361/807
2012/0113572 A1 * 5/2012 Gaddis, II ..... G06F 1/1628 361/679.01
2012/0299832 A1 * 11/2012 Peterson ..... G06F 3/0202 345/168
2012/0308981 A1 * 12/2012 Libin ..... G09B 3/00 434/362
2013/0082051 A1 * 4/2013 Kaufmann ..... A47G 21/14 220/23.83
2013/0286551 A1 * 10/2013 Ashcraft ..... G06F 1/1679 361/679.01
2013/0294020 A1 * 11/2013 Rayner ..... H05K 5/061 361/679.01
2013/0321990 A1 12/2013 Chung et al.
2014/0043121 A1 * 2/2014 Sartee ..... G06F 1/16 335/219
2014/0049894 A1 * 2/2014 Rihn ..... G06F 1/1616 361/679.27
2014/0062629 A1 * 3/2014 Ow ..... G06F 1/1626 335/285
2014/0184904 A1 * 7/2014 Lam ..... G06F 1/1616 348/375
2014/0311880 A1 * 10/2014 Krumpelman ..... H01H 13/14 200/5 A
2014/0347803 A1 * 11/2014 Imamura ..... G06F 1/1616 361/679.21
2015/0002979 A1 * 1/2015 Liu ..... H01F 7/0252 361/144
2015/0009399 A1 * 1/2015 Jonsson ..... G06F 1/1656 348/373
2015/0049426 A1 * 2/2015 Smith ..... A45C 11/00 361/679.27
2015/0188389 A1 * 7/2015 Wan ..... F03G 7/08 290/1 A
2015/0237748 A1 * 8/2015 Andre ..... H05K 5/0221 361/679.55
2015/0277491 A1 * 10/2015 Browning ..... G06F 1/1632 361/679.44
2016/0032952 A1 * 2/2016 McBroom ..... F16B 21/165 24/303
2016/0190903 A1 * 6/2016 Ohishi ..... H02K 35/04 310/28
2016/0233911 A1 * 8/2016 Sirichai ..... A45C 11/00

* cited by examiner

MAGNETICALLY ACTUATED RESTRAINING MECHANISMS

CROSS-REFERENCE TO RELATED APPLICATIONS

The present application claims the benefit of U.S. Provisional Application No. 62/234,005, entitled "MAGNETICALLY ACTUATED RESTRAINING MECHANISMS" filed Sep. 28, 2015, the content of which is incorporated herein by reference in its entirety for all purposes.

FIELD

The following disclosure relates to magnetic clamping or locking mechanisms. In particular, the following disclosure relates to mechanism utilizing permanent-electromagnetic magnets as an actuator for locking or clamping. These mechanisms can be used in electronic devices themselves and/or goods associated with electronic devices such as clothing, bags, cases etc.

BACKGROUND

Magnets are used in consumer products and in particular, electronic devices, in many ways to enhance a user experience. By way of example, magnets can be used to hold a lid of a laptop shut, to connect a case to an electronic device, or for retaining a device charger to an electronic device among numerous other applications. With the ubiquity of electronic devices, using magnets in a greater number of applications is a growing consideration and the ability to control magnetization of a magnet when desired can lead to a greater number of desirable applications.

SUMMARY

Some embodiments can include a retention mechanism having a first component including a first clasping surface and a first magnet having a first polarity as well as a second component having a second clasping surface configured to be alignable to and to coordinate with the first clasping surface. The second component can have a magnetic assembly having an effective polarity that varies in accordance with a electric current pulse received at the magnetic assembly, where a magnetic circuit is formed between the first magnet and the magnetic assembly, and where, when the effective polarity of the magnetic assembly is the first polarity, the magnetic circuit is repulsive causing the first and second clasping surfaces to separate, otherwise, the magnetic circuit is attractive causing the clasping surfaces to come together.

Some embodiments can include a method performed by a retaining mechanism, the retaining mechanism having a first component including a first clasping surface and a first magnet having a first polarity as well as a second component including a second clasping surface configured to be alignable to and to coordinate with the first clasping surface. The second component can include a magnetic assembly having an effective polarity that varies in accordance with an electric current pulse received at the magnetic assembly, wherein a magnetic circuit is formed between the first magnet and the magnetic assembly. The method can include receiving, at the magnetic assembly, a pulse of an electric charge from a power source and switching the effective polarity of the magnetic assembly, where when the effective polarity of the magnetic assembly is the first polarity, the magnetic circuit is repulsive causing the first and second clasping surfaces to separate, otherwise, the magnetic circuit is attractive causing the clasping surfaces to come together.

In some embodiments, the magnetic assembly is an electro-permanent magnet. In some embodiments, the first clasping surface and the second clasping surface are configured to mechanically lock with each other. In some embodiments, the second component further comprises a base and a clasping arm extending from the base to the clasping surface, the first magnet being arranged within the clasping arm.

In some embodiments, the second component further comprises a second magnet having a second polarity, the second magnet being arranged in the base where a magnetic circuit is formed between the second magnet and the magnetic assembly, and where when the effective polarity of the magnetic assembly is the second polarity, the magnetic circuit is repulsive causing the first component and the second component to repel each other, otherwise, the magnetic circuit is attractive causing the first component and the second component to attract each together.

In some embodiments the second component further comprises a second clasping arm extending from the base to a second clasping surface configured to be alignable to and to coordinate with a second clasping surface and a third magnet having the first polarity being arranged within the second clasping arm. In some embodiments the clasping arms are formed of a flexible material. In some embodiments the clasping arms are hinged to the base.

Some embodiments can include an electronic device including a first component having a first retention surface, a first magnet having a first polarity, and a second magnet having a second polarity opposite the first polarity. The electronic device can have a second component including a second retention surface configured to be alignable to and to coordinate with the first retention surface and a third magnet having a third polarity and located at a first position. The second component can include a magnetic assembly having an effective polarity that varies in accordance with an electric current pulse received at the magnetic assembly, where a magnetic circuit is formed between the third magnet and the magnetic assembly, and where, when the effective polarity of the magnetic assembly is the third polarity, the magnetic circuit is repulsive causing the third magnet to actuate to a second position causing the first retention surface to separate from the second retention surface, otherwise, the magnetic circuit is attractive maintaining the second magnet in the first position causing the first retention and the second retention surface to come together.

In some embodiments, the magnetic assembly is an electro-permanent magnet. In some embodiments, the first polarity is the third polarity. In some embodiments, the second polarity is the third polarity. In some embodiments, the first component is a laptop lid and the second component is a laptop base. In some embodiments, the third magnet moves laterally within the laptop base.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The disclosure will be readily understood by the following detailed description in conjunction with the accompanying drawings, wherein like reference numerals designate like structural elements, and in which.

Figure 1:
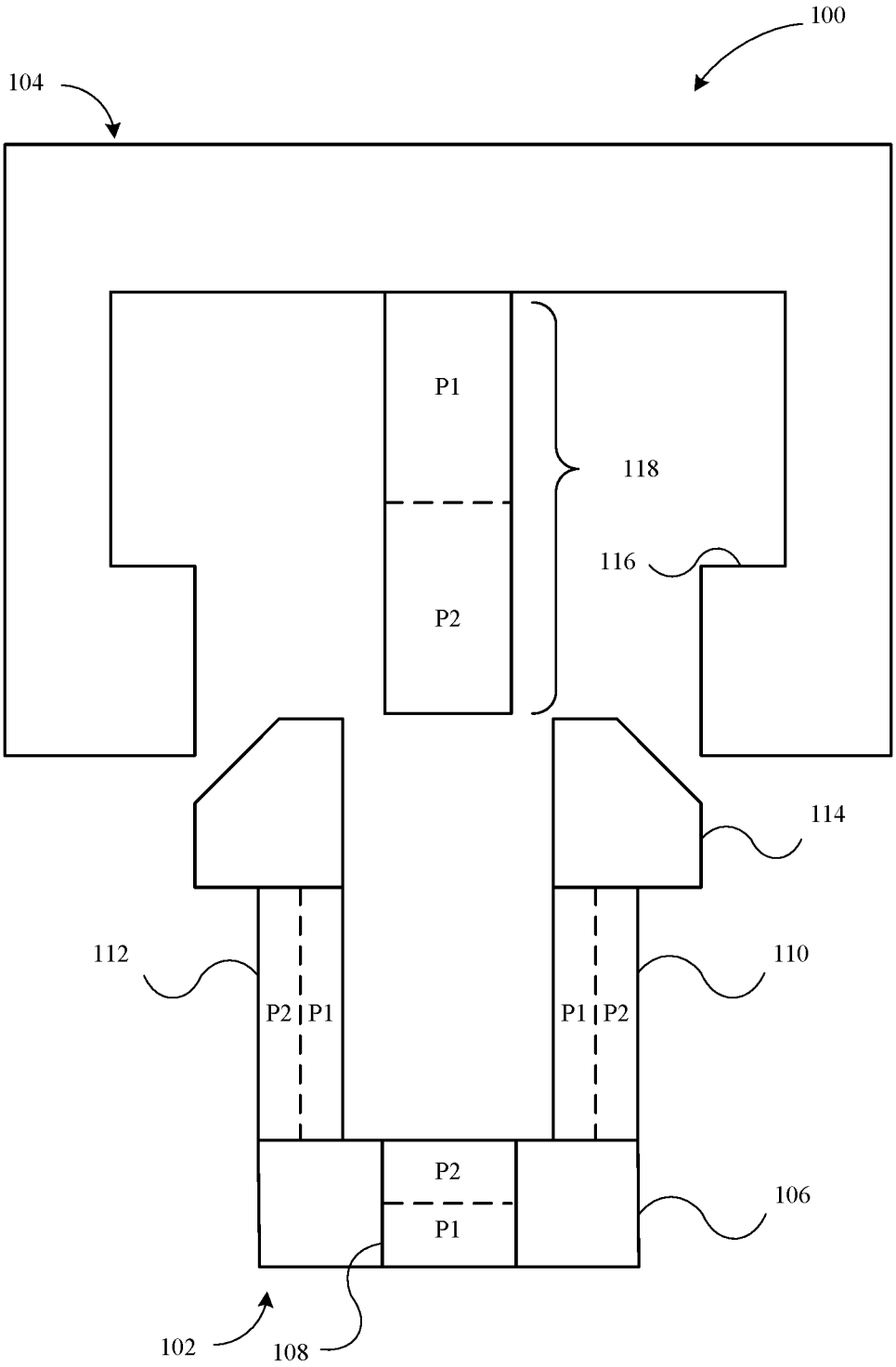
FIG. 1 shows a schematic of an electro-permanent magnet actuated clasping mechanism shown in a first un-locked state in accordance with the described embodiments.

Those skilled in the art will appreciate and understand that, according to common practice, various features of the drawings discussed below are not necessarily drawn to scale, and that dimensions of various features and elements of the drawings may be expanded or reduced to more clearly illustrate the embodiments of the present invention described herein.

DETAILED DESCRIPTION

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting such that other embodiments may be used, and changes may be made without departing from the spirit and scope of the described embodiments.

The following disclosure relates to magnetically controlled retaining mechanisms. Described embodiments can be used in electronic devices and consumer products associate with electronic devices such as cases, backpacks, briefcases, covers, clothing and wearables among numerous other products where an electric charge can be provided to the retaining mechanism. The described embodiments utilize electro-permanent magnets to activate the retention mechanisms in the described embodiments.

Traditional electro magnets are magnets that use electrical power to provide a magnetic force. Electro magnets require a continuous power draw to keep the magnet force turned on. As electronic devices and associated goods and accessories become smaller and smaller and the desirability for longer battery life becomes greater and greater, minimizing power draw is a major consideration in developing such devices and goods. Electro-permanent magnets can be turned on and off without requiring a continuous power draw. Polarity of an electro-permanent magnet can also be switched or reversed without requiring a continuous power draw. Electro-permanent magnets can sometimes include a soft magnet and a hard magnet. A hard magnet is a magnet where the magnetism cannot be changed or is difficult to change. A soft magnet is a magnet were the magnetism can be changed or is easily changed. The ability to switch magnetism of a magnet is referred to as its coercivity. Hard magnets have low coercivity and soft magnets have high coercivity. One way the magnetism of a soft magnet can be changed is by arranging it in a coil and pulsing the magnet with an electric charge. Pulsing the magnet with the electric charge can switch the polarity of the soft magnet. By coupling a soft magnet with a hard magnet, the polarity of the magnet combination can be controlled or the magnet can be turned on and off.

For example, when the polarity of the soft magnet is the same as the hard magnet, for instance both magnets have a positive polarity, the sum of polarities creates a net positive polarity of the magnet combination. Pulsing the magnet combination can cause the soft magnet to change polarity to negative, but the hard magnet will maintain its positive polarity given that the hard magnet resists changing polarity. If the strength of the magnetic field of each magnet is equal, the soft and hard magnet will create a magnetic loop, essentially cancelling each other out and a net zero magnetism will be emitted from the magnet combination, effectively turning the magnet combination off. By configuring an electro-permanent magnet as described the electro-permanent magnet can be turned on and off, or its polarity can be switched, merely by pulsing the magnet with the eclectic charge when desired.

The ability to turn on or off, or reverse the polarity of an electro-permanent magnet, can be used in a variety of ways. Some applications for using electro-permanent magnets can include actuating clasping or locking mechanisms in accordance with the described embodiments. For example, one such clasping mechanism can be a buckle, such as a seat-belt buckle, backpack buckle, belt buckle or the like. Clasping mechanisms can also include zippers. Electro-permanent magnets can be arranged in the buckle clasp and/or a retention portion of the buckle. Depending on how the electro-permanent magnets are arranged, when the electro-permanent magnets are turned on or off, they can repel or attract the magnets arranged in the flexible clasping tabs of a buckle clasp to release or lock with the retention portion of the buckle. In this way, by controlling the electro-permanent magnets, the locking or unlocking of the buckle clasps can be controlled. In addition, magnets can be arranged in the buckle clasp base portion to coordinate with electro-permanent magnets in the retention portion to repel or attract the two portions depending on the polarity of the electro-permanent magnet. In this way, by activating or switching polarity of the electro-permanent magnet, the clasp portion and retention portion can selectively be pulled together or pushed apart. In some embodiments, the controlling of the locking in combination with the controlled pulling and pushing of the clasp and retention portions can result in the buckle self-buckling or self unbuckling merely by providing an electric charge to the electro permanent magnet.

In some exemplary embodiments, electro-permanent magnets can be used in electronic devices, for example, for locking a laptop lid closed or for pushing a laptop lid open. For instance, a laptop base and laptop lid can have coordinating clasping and retaining portions that can be actuated by electro-permanent magnets to lock or unlock the lid to the base. Alternatively, a magnet can be arranged in the lid of a laptop. An additional electro-permanent magnet can be arranged in a laptop base to align with the magnet in the lid. To lock the laptop lid, the electro-permanent magnets can be magnetized such that the magnet in the lid is attracted to the electro-permanent magnet in the base, thus holding the lid closed to the base using magnetic force. The electro-permanent magnet can be switched to an opposite polarity so that the magnet in the lid is repelled upward by the electro-permanent magnet in the base, causing the lid to pop open. Alternatively an arrangement of magnets can be configured in the lid or base of a laptop and the electro-permanent can be used to repel or attract other magnets into a locking or unlocking position.

In some exemplary embodiments, electro-permanent magnets can be used to connect a cover to an electronic device or to locate end magnets in a foldable cover to a predetermined location on the cover. Electro-permanent magnets can be arranged in a mobile electronic device for example, such as a smartphone or tablet as well as in a coordinating case. The electro-permanent magnets can be activated, turned on or off, or reversed to retain the case to the mobile electronic device. In some embodiments the electro-permanent magnets can be arranged to activate locking and or clasping mechanisms on the case and/or mobile electronic device to secure the device. In some embodiments the electro-permanent magnets can be used in a wearable electronic device.

In some exemplary embodiments, electro-permanent magnets can be used in the engaging portions of a zipper on a piece of clothing, bag, or case for example. Electro-permanent magnets can be arranged in the components such that a zipper tab can be propelled by electromagnets. In some embodiments, electro-permanent magnets can be used as an actuator in mechanism that otherwise are maintained in a state of equilibrium. The actuator can be part of a locking, clasping or retaining mechanism having larger magnets configured in a static state. The electro-permanent magnet trigger can push the large magnets out of equilibrium forcing a locking, clasping or retaining mechanism to lock or release. The embodiments described are exemplary of numerous other potential embodiments, which can include self-closing and self opening zippers, watch bands, belt buckles, etc.

These and other embodiments are discussed below with reference to FIGS. 1-6. However, those skilled in the art will readily appreciate that the detailed description given herein with respect to these Figures is for explanatory purposes only and should not be construed as limiting.

FIG. 1 shows a schematic of a clasping mechanism 100 shown in an unlocked position in accordance with the described embodiments. The clasping mechanism 100 can have a retention component 104 that is configured to coordinate with and engage with a clasping component 102. The clasping component 102 can have a base 106 where a base magnet 108 can be arranged. The clasping component can have clasping arms 110 extending from base 106. The clasping arms 110 can be moveable. The clasping arms 110 can take the form of a pivotable mechanism, such as being hinged to the base 106, or can be formed of a flexible material such as plastic, that is able to bend or flex. The clasping arms 110 can include arm magnets 112. The arm magnets 112 and the base magnet 108 can take the form of a hard magnet having a low coercivity, which means the polarity of the magnet is difficult to change and thus the polarity of the magnet stays substantially permanent. Hard magnets (or magnets with low coercivity) can also be referred to as permanent magnets. The clasping arms 110 can have clasping tabs 114 at the ends of the clasping arms 110 for engaging locking tabs 116 of retention component 104. Retention component 104 can include an electro-permanent magnet ("EPM") 118 arranged centrally to the retention component 104. The EPM 118 can be an electro-permanent magnet where the polarity of the EPM 118 be changed in response to an electrical charge pulse. In some embodiments the EPM 118 can have zero polarity, in effect turning the EPM 118 off. Polarities, P1 and P2 can be opposite each other. Here, the EPM 118 is configured as shown and, for example, that its polarity is such that the EPM 118 P1 (which can be a South polarity for purpose of this discussion) is at an end nearest where the retention component 104 would engage with the clasping component 102. The arm magnets 112 are each configured such that the P1 polarity of arm magnets 112 is nearest the EPM 118. In this configuration, arm magnets 112 are attracted toward the EPM 118, and the clasping tabs 114, do not engage locking tabs 116. Additionally, given the polarity of EPM 118 in this condition, the EPM 118 repels base magnet 108, located in base 106, and thus pushes the clasping component 102 away from retention component 104, eliminating the need to pull the components away from each other with additional force.

Figure 2:
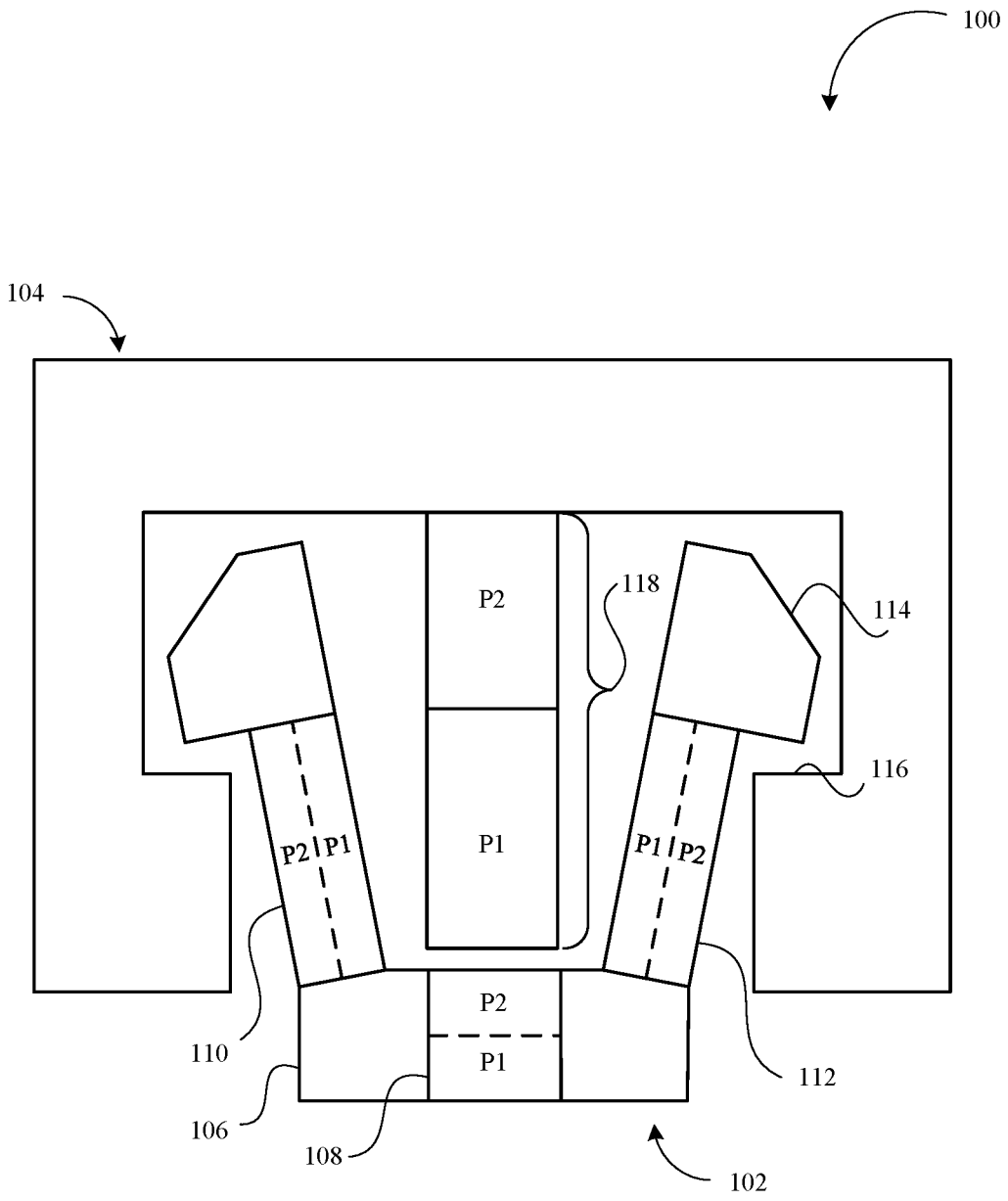
FIG. 2 shows a schematic of an electro-permanent magnet actuated clasping mechanism shown in FIG. 1 in a locked state.

FIG. 2 shows a schematic of a clasping mechanism 100 shown in a locked position in accordance with the described embodiments. The polarity of the EPM 118 can be reversed by receiving an electrical charge pulse from power source (not shown). The pulse can be initiated in any number of ways including by a touch input on a button, touchscreen or electronic device input such as a mouse or keyboard and so on. The input can alternatively be automatically initiated by software running on a processor or an electronic device. When the polarity of the EPM 118 is reversed, the EPM 118 attracts base magnet 108. As it does so, the EPM 118 simultaneously repels arm magnets 112 such that clasping arm 110 causes clasping tabs 114 to engage locking tabs 116. In this way, the clasping mechanism 100 can lock, without the need for continuous power draw. Un-locking the clasping mechanism 100 merely requires receiving another electrical charge pulse from the power source, switching the polarity of the EPM 118, which will attract arm magnets 112 pulling clasping arms 110, causing clasping tabs 114 to disengage from locking tabs 116. The EPM 118 will also repel base magnet 108 and thus push clasping component 102 from retention component 104.

Figure 3A:
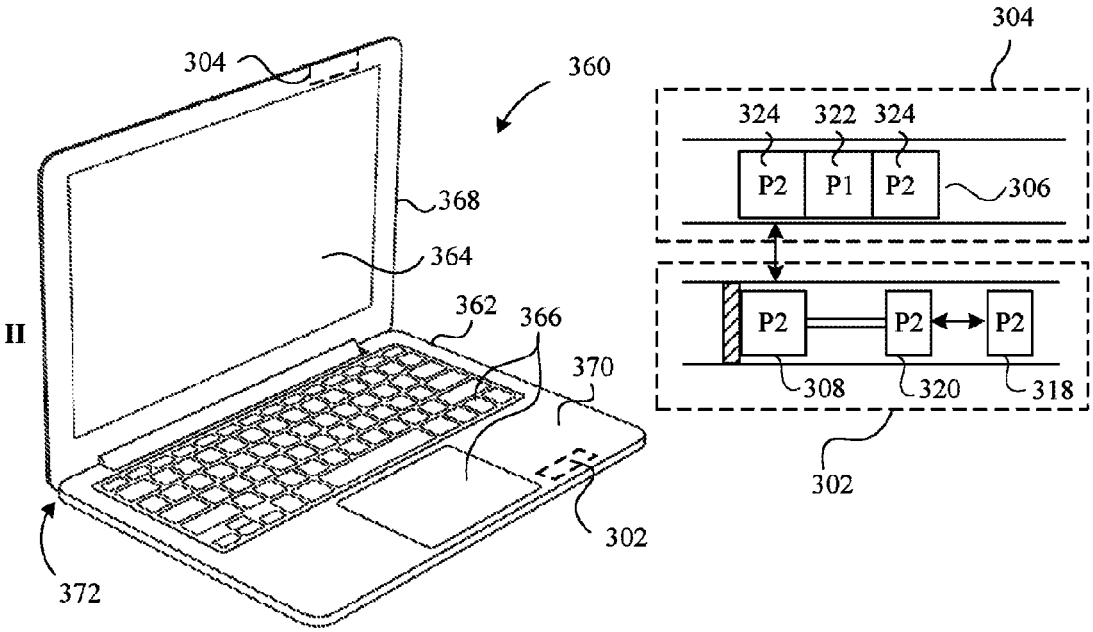
FIG. 3 shows an electronic device utilizing an electro-permanent magnet actuated restraining mechanism in accordance with the described embodiments.
Figure 3B:
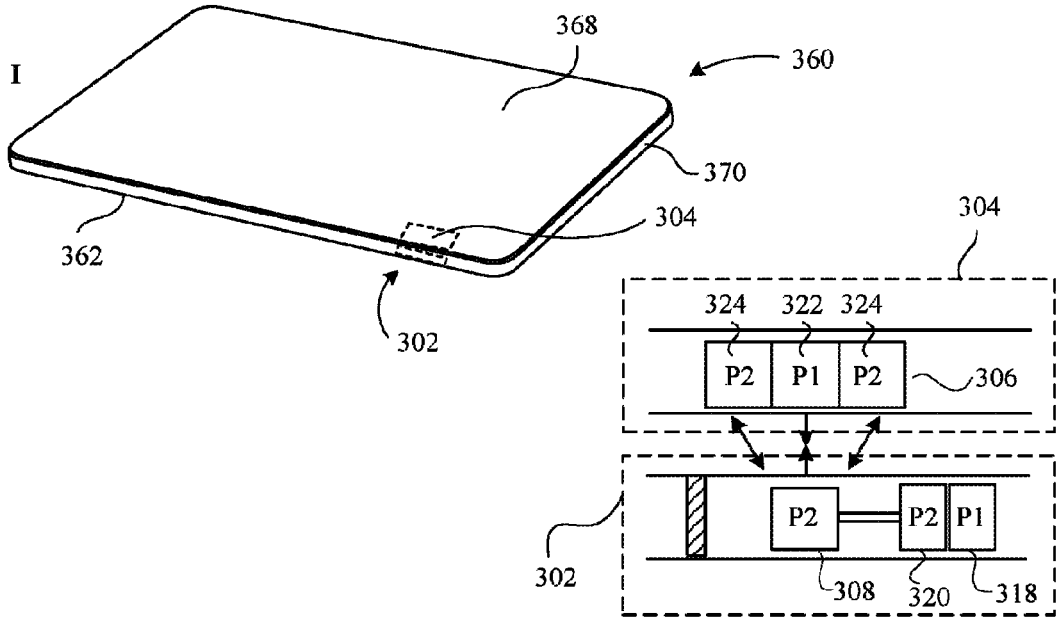

FIGS. 3*a* and 3*b* show a front view of an electronic device 360 utilizing an embodiment of clasping mechanism in accordance with the described embodiment. In some embodiments, and as shown in FIGS. 3*a* and 3*b*, the electronic device 360 is a portable electronic device, such as a laptop. The laptop, as shown in FIGS. 3*a* and 3*b*, includes a first component that can take the form of a lid 368 that is rotatably attached by a hinge 372 to an end of a second component that can take the form of base 370. In other embodiments, the electronic device 360 can be a wearable, smartphone, tablet or the like. Electronic device 360 may include a housing 362 formed from a rigid material, such as a metal (including stainless steel or aluminum). The electronic device 360 may include a display module 364 designed to display visual content. In some embodiments, the display module 364 is a light-emitting diode ("LED") display. Further, in some embodiments, the display module 364 is an organic light-emitting diode ("OLED") display. The electronic device 360 may include input features 366 electrically coupled with one or more processors (not shown), and designed to control the display module 364. The electronic device 360 can have a retention portion 304 configured in the lid 368. The electronic device 360 can have restraining component 302 arranged in the base 370. Retention portion 304 or restraining component 302 can be arranged at any number of locations so long as retention portion 304 is arranged opposite restraining component 302 and the coordinating components of the electronic device 360 to be retained. In one embodiment, the restraining component 302 can simply be an electro-permanent magnet that can have a polarity selectively switched to be the opposite polarity as magnets that make up retention portion 304. In this way the respective polarities attract and retain the lid 368 to the base 370. Restraining component 302 can have a polarity selectively switched to be the same polarity as magnets that make up retention portion 304 thus repelling and popping the lid 368 open and away from base 370. An alternative embodiment for the retaining and releasing of lid 368 to and from base 370 is further illustrated in FIG. 4 below.

FIG. 3*a* shows magnets arranged within the restraining component 302, the arrangement corresponding to a lid opening or lid unlocked state. FIG. 3*b* shows magnets arranged within the restraining component 302, the arrangement corresponding to a lid closed or lid locked state. For example, FIG. 3*a* shows a schematic configuration of electronic device 360 showing retention portion 304 having lid magnets 306 (that include first magnet 322 and second magnets 324) arranged in a fixed position and in an alternating polarity pattern (shown as P2P1P2) and carried by lid 368. Restraining component 302 can be carried by base 370 and can include a magnetic assembly having an electro-permanent magnet 418 having a polarity that varies in accordance with an applied current. The restraining component 302 can further include base magnet 308 and driver magnet 320 in proximity to electro-permanent magnet 318. It should be noted that restraining component 302 is capable of retaining (or repelling) lid 368 to or from base 370. In the lid closed and locked state, or state I (as shown in FIG. 3*b*), first magnet 322 can align with and magnetically attract base magnet 308 and thereby secure lid 368 and base 370 together. In the lid opening or unlocked state, or state II (as shown in FIG. 3*a*), second magnet 324 can align with and magnetically repel base magnet 308 and thereby move lid 368 and base 370 away from each other. State III (not shown) may be described as a state where the lid is transitioning between state II and state I. It should be noted that base magnet 308 can have a polarity as shown (as P2) and is capable of moving laterally from a first position (as shown in FIG. 3*b*), to a second position (as shown in FIG. 3*a*). As above, retention portion 304 and restraining component 302 are capable of locking the lid 368 to the base 370 due to the opposing polarities of first magnet 322 and base magnet 308 that generate a magnetic attractive force that is greater than a repulsion force generated by base magnet 308 and second magnets 324. Moreover, driver magnet 320 can be connected to base magnet 308, and accordingly, driver magnet 320 is also capable of moving laterally from the first position to the second position. Driver magnet 320 can be described as a third magnet having a third polarity since the polarity of driver magnet 320 is not related to that of base magnet 308 (however, in this case the polarity is the same as base magnet 308). Accordingly, driver magnet 320 can have a polarity that opposes or matches that of electro-permanent magnet (EPM) 318 depending upon the current applied to EPM 318.

Figure 4:
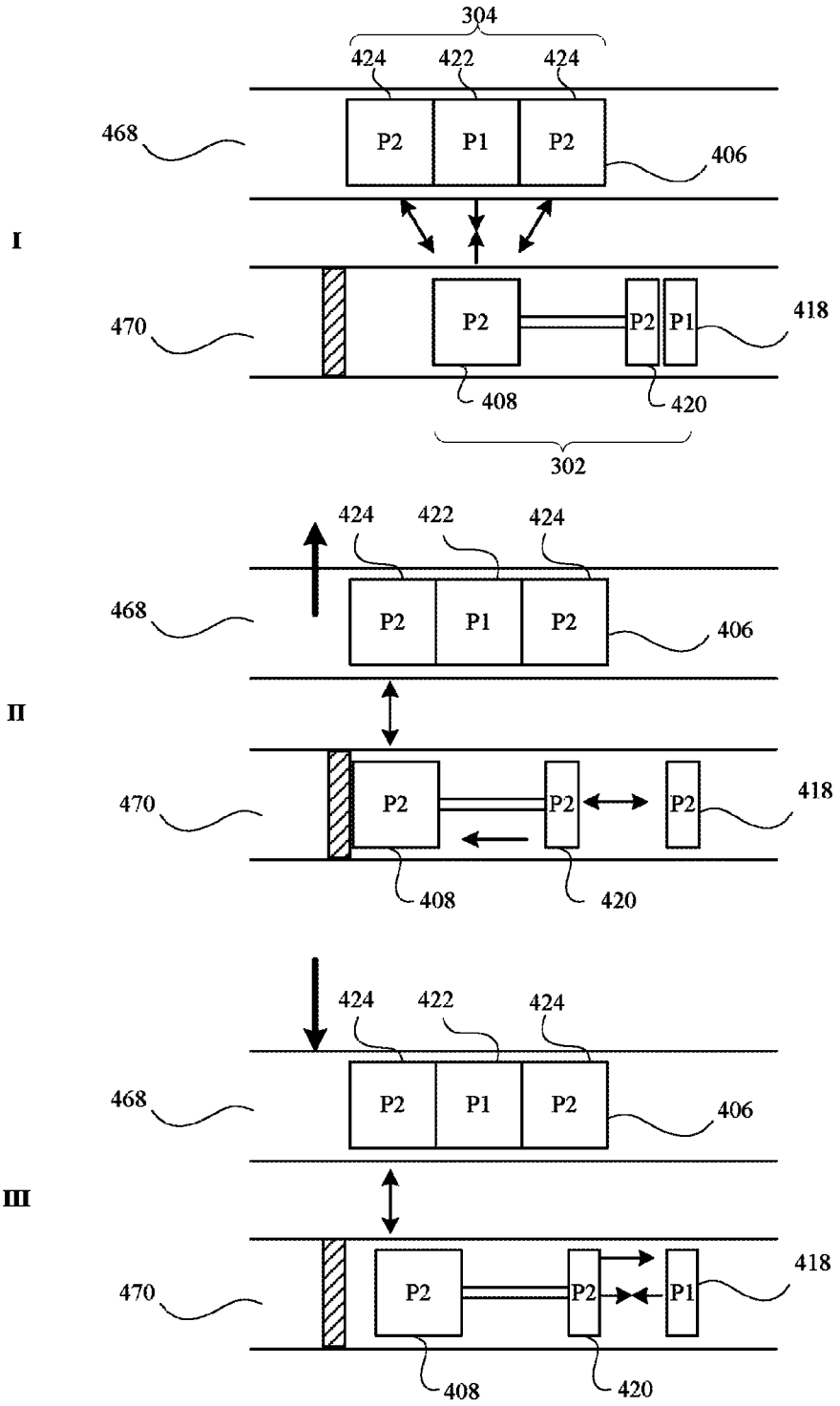
FIG. 4 a schematic of one embodiment of the an electro-permanent magnet actuated restraining mechanism utilized in the electronic device of FIG. 3.

FIG. 4 shows a schematic configuration of electronic device 360 showing retention portion 304 having lid magnets 406 (that include first magnet 422 and second magnets 424) arranged in a fixed position and in an alternating polarity pattern (shown as P2P1P2) and carried by lid 468. Restraining component 302 can be carried by base 470 and can include a magnetic assembly having an electro-permanent magnet 418 having a polarity that varies in accordance with an applied current. The restraining component 302 can further include base magnet 408 and driver magnet 420 in proximity to electro-permanent magnet 418. It should be noted that restraining component 302 is capable of retaining (or repelling) lid 468 to or from base 370. In a lid closed and locked state, (shown as state I), lid magnets 406 can magnetically attract base magnet 408 and thereby secure lid 468 and base 470 together. It should be noted that base magnet 408 can have a polarity as shown (as P2) and is capable of moving laterally from a first position (as shown in locked state I), to a second position (as shown in lid opening state II). As above, retention portion 304 and restraining component 302 are capable of locking the lid 468 to the base 470 due to the opposing polarities of first magnet 422 and base magnet 408 that generate a magnetic attractive force that is greater than a repulsion force generated by base magnet 408 and second magnets 424. Moreover, driver magnet 420 can be connected to base magnet 408, and accordingly, driver magnet 420 is also capable of moving laterally from the first position to the second position. Driver magnet 420 can be described as a third magnet having a third polarity since the polarity of driver magnet 420 is not related to that of base magnet 408 (however, in this case the polarity is the same as base magnet 408). Accordingly, driver magnet 420 can have a polarity that opposes or matches that of electro-permanent magnet (EPM) 418 depending upon the current applied to EPM 418.

As illustrated in lid opening state II, also known as an unlocked state, to force the lid 468 open, an electrical charge pulse can be received by EPM 418 in one embodiment to switch the polarity of EPM 418. The switched polarity now causes EPM 418 to repel driver magnet 420, which in turn pushes base magnet 408 out of a state of equilibrium and into a region where a polarity of the base magnet 408 repels lid magnets 406 causing the lid 468 to pop away from the base 470. Returning the lid to a retained or locked state is illustrated in a closing state III. A force applied downward on the lid 468, for example by a user, can be coordinated with a electrical charge pulse received at the EPM 418, which will cause base magnet 408 to move back to the equilibrium state with respect to the lid magnets 406 causing the lid 468 to be restrained closed.

Figure 5:
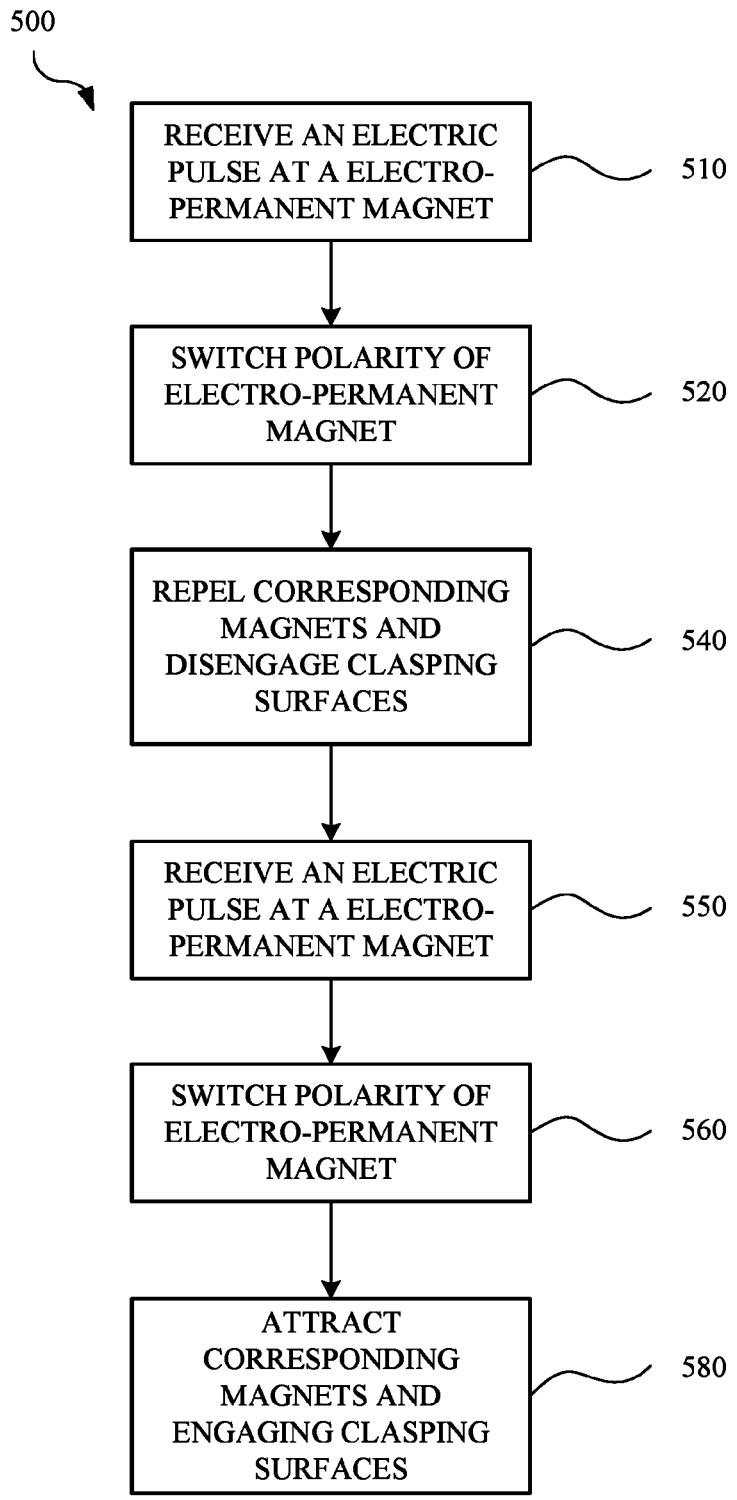
FIG. 5 is a flow chart of a method performed by a retaining mechanism in accordance with the described embodiments; and, FIG. 6 is a block diagram of an electronic device suitable for use with the described embodiments.

FIG. 5 shows a flow chart for a method 500 for locking and releasing a clasping mechanism 100 in accordance with the described embodiments. Method 500 can be performed in any order. For example the method 500 can begin with the clasping mechanism 100 in the locked state. Alternatively, the method 500 can begin with the clasping mechanism 100 in the un-locked state. The method 500 can include in 510, receiving an electric charge at EPM 118, when the clasping component 102 is locked with the retention component 104. In 520, the method 500 can switch the polarity of EPM 118. In 530, the method 500 can attract the arm magnets 112, disengaging clasping tabs 114 while also repelling clasping component 102 to a predetermined distance away from retention component 104. In 540 method 500 can begin with the unlocking of clasping mechanism 100 by receiving an electric charge at the EPM 118 when the clasping component 102 is arranged within a pre-determined distance of the retention component 104. In 550, the method 500 can switch the polarity of EPM 118. In 560, the method 500 can attract the clasping component 102 and repel the arm magnets 112 to engage clasping tabs 114, thus restraining clasping component 102 into retention component 104.

Figure 6:
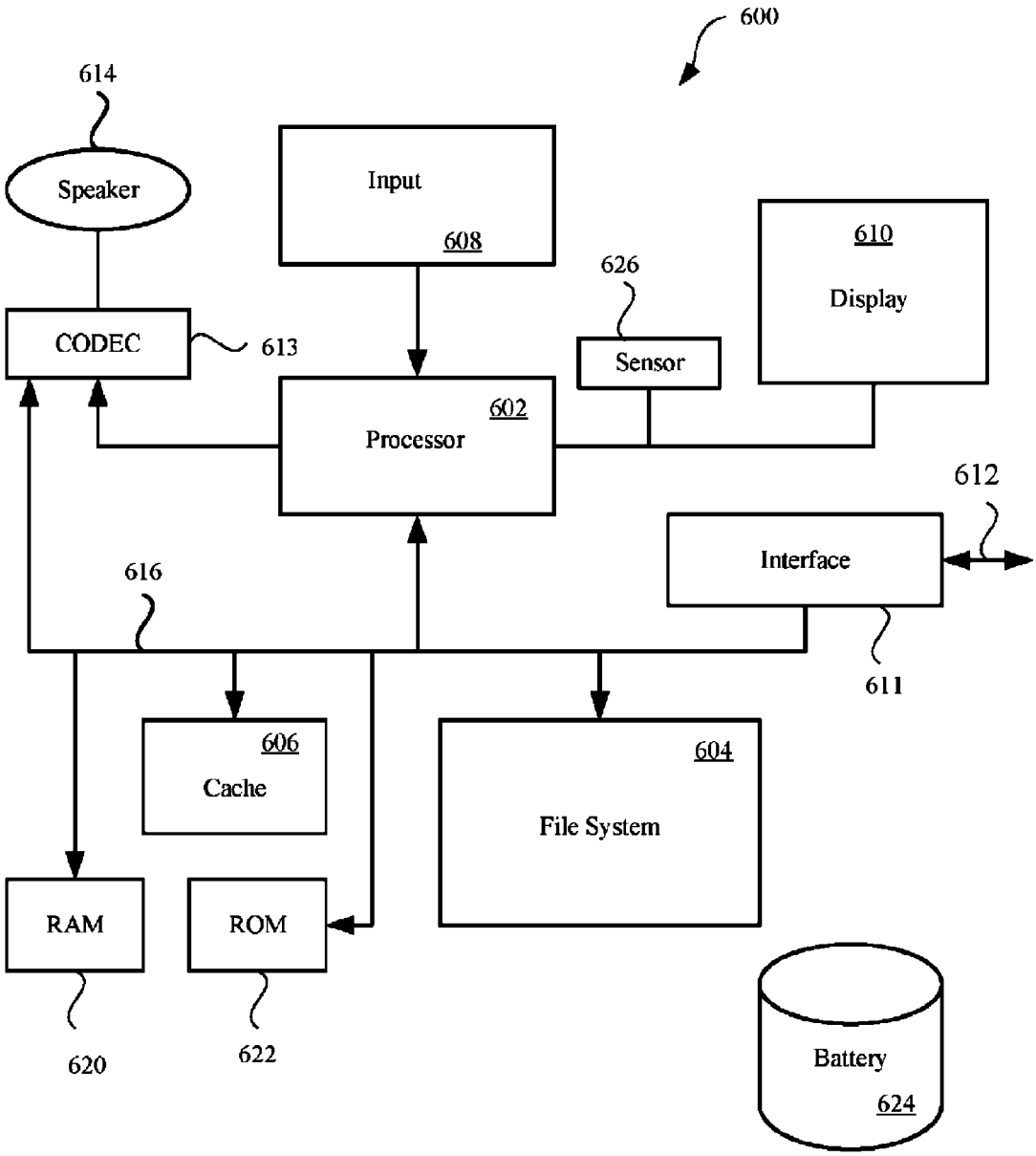

FIG. 6 is a block diagram of an electronic device 600 suitable for use with the described embodiments. The electronic device 600 illustrates circuitry of a representative computing device. The electronic device 600 includes a processor 602 that pertains to a microprocessor or controller for controlling the overall operation of the electronic device 600. The electronic device 600 stores media data pertaining to media items in a file system 604 and a cache 606. The file system 604 is, typically, a semiconductor memory, cloud storage, or storage disks or hard drives. The file system 604 typically provides high capacity storage capability for the electronic device 600. However, since the access time to the file system 604 is relatively slow, the electronic device 600 can also include a cache 606. The cache 606 is, for example, Random-Access Memory (RAM) provided by semiconductor memory. The relative access time to the cache 606 is substantially shorter than for the file system 604. However, the cache 606 does not have the large storage capacity of the file system 604. Further, the file system 604, when active, consumes more power than does the cache 606. The power consumption is often a concern when the electronic device 600 is a portable media device that is powered by a battery 624. The electronic device 600 can also include a RAM 620 and a Read-Only Memory (ROM) 622. The ROM 622 can store programs, utilities or processes to be executed in a non-volatile manner. The RAM 620 provides volatile data storage, such as for the cache 606.

The electronic device 600 also includes a user input device 608 that allows a user of the electronic device 600 to interact with the electronic device 600. For example, the user input device 608 can take a variety of forms, such as a button, keypad, dial, touch screen, audio input interface, visual/image capture input interface, input in the form of sensor data, etc. Still further, the electronic device 600 includes a display 610 (screen display) that can be controlled by the processor 602 to display information to the user. A data bus 616 can facilitate data transfer between at least the file system 604, the cache 606, the processor 602, and the CODEC 613.

In one embodiment, the electronic device 600 serves to store a plurality of media items (e.g., songs, podcasts, etc.) in the file system 604. When a user desires to have the electronic device play a particular media item, a list of available media items is displayed on the display 610. Then, using the user input device 608, a user can select one of the available media items. The processor 602, upon receiving a selection of a particular media item, supplies the media data (e.g., audio file) for the particular media item to a coder/decoder (CODEC) 613. The CODEC 613 then produces analog output signals for a speaker 614. The speaker 614 can be a speaker internal to the electronic device 600 or external to the electronic device 600. For example, headphones or earphones that connect to the electronic device 600 would be considered an external speaker.

The electronic device 600 also includes a network/bus interface 611 that couples to a data link 612. The data link 612 allows the electronic device 600 to couple to a host computer or to accessory devices. The data link 612 can be provided over a wired connection or a wireless connection. In the case of a wireless connection, the network/bus interface 611 can include a wireless transceiver. The media items (media assets) can pertain to one or more different types of media content. In one embodiment, the media items are audio tracks (e.g., songs, audio books, and podcasts). In another embodiment, the media items are images (e.g., photos). However, in other embodiments, the media items can be any combination of audio, graphical or visual content. Sensor 626 can take the form of circuitry for detecting any number of stimuli. For example, sensor 626 can include a Hall Effect sensor responsive to external magnetic field, an audio sensor, a light sensor such as a photometer, and so on.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings.

What is claimed is:

1. An electronic device comprising:

a first component comprising:

a retention portion that includes a first magnet having a first polarity, and a second magnet having a second polarity opposite the first polarity; and a second component comprising:

a restraining component configured to be alignable to and to coordinate with the retention portion, the restraining component including:

a third magnet having a third polarity and located at a first position, and a magnetic assembly having an effective polarity that varies in accordance with an electric current pulse received at the magnetic assembly, wherein a magnetic circuit is formed between the third magnet and the magnetic assembly, and wherein when the effective polarity of the magnetic assembly is switched to the third polarity of the third magnet, the magnetic circuit is repulsive causing the third magnet to actuate to a second position causing the retention portion to separate from the restraining component, otherwise, the magnetic circuit is attractive maintaining the third magnet in the first position causing the retention portion and the restraining component to come together.

2. The electronic device of claim 1, wherein the magnetic assembly is an electro-permanent magnet.

3. The electronic device of claim 1, wherein the first polarity is the same as the third polarity.

4. The electronic device of claim 1, wherein the second polarity is the same as the third polarity.

5. The electronic device of claim 1, wherein the first component is a laptop lid and the second component is a laptop base.

6. The electronic device of claim 5, wherein the third magnet moves laterally between the first position and the second position within the laptop base.

7. A portable electronic assembly, comprising:

an electronic device including a base portion;

a lid configured to be retained to the base portion of the electronic device;

a retention portion comprising a first magnet having a first polarity; and a restraining component comprising a magnetic assembly having a variable effective polarity and a base magnet having a second polarity that magnetically interacts with the first magnet of the retention portion;

wherein the effective polarity of the magnetic assembly selectively switches in response to receiving an electric current pulse; and wherein switching the effective polarity of the magnetic assembly alters the magnetic interaction between the retention portion and the restraining component via the first magnet and the base magnet, which moves the lid either:

(i) from a locked state to an unlocked state with respect to the base portion; or (ii) from the unlocked state to the locked state with respect to the base portion.

8. The portable electronic assembly of claim 7, wherein the magnetic assembly is an electro-permanent magnet.

9. The portable electronic assembly of claim 7, wherein the retention portion and the restraining component are configured to mechanically lock with each other.

10. The portable electronic assembly of claim 7, wherein the retention portion is arranged in the lid and the restraining component is arranged in the base portion of the electronic device.

11. The portable electronic assembly of claim 10, wherein when the effective polarity of the magnetic assembly is selectively switched to match the second polarity of the base magnet, the magnetic interaction between the retention portion and the restraining component is repulsive causing the retention portion and the restraining component to repel each other otherwise, the magnetic interaction between the retention portion and the restraining component is attractive causing the retention portion and the restraining component to attract each together.

12. The portable electronic assembly of claim 7, wherein the lid is rotatably attached by a hinge to an end of the base portion of the electronic device.

13. The portable electronic assembly of claim 7, wherein the first magnet is embedded in the lid and the base magnet is embedded in the base portion.

* * * * *